US009407049B2

(12) United States Patent
Ishibashi et al.

(10) Patent No.: US 9,407,049 B2
(45) Date of Patent: Aug. 2, 2016

(54) DEVICE CONNECTOR

(71) Applicant: Sumitomo Wiring Systems, Ltd., Yokkaichi, Mie (JP)

(72) Inventors: Takeshi Ishibashi, Yokkaichi (JP); Yasushi Okayasu, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 5 days.

(21) Appl. No.: 14/059,526

(22) Filed: Oct. 22, 2013

(65) Prior Publication Data

US 2014/0127939 A1 May 8, 2014

(30) Foreign Application Priority Data

Nov. 7, 2012 (JP) ..... 2012-245249

(51) Int. Cl.

| | |
|---|---|
| ***H01R 13/74*** | (2006.01) |
| ***H01R 13/639*** | (2006.01) |
| *H01R 13/60* | (2006.01) |
| *H01R 13/447* | (2006.01) |

(52) U.S. Cl.

CPC ..... *H01R 13/748* (2013.01); *H01R 13/6397* (2013.01); *H01R 13/447* (2013.01); *H01R 13/60* (2013.01)

(58) Field of Classification Search

CPC .. H01R 13/60; H01R 13/6397; H01R 13/447; H01R 13/443

USPC ..... 439/148, 133, 134, 911

See application file for complete search history.

(56) References Cited

U.S. PATENT DOCUMENTS 4,662,697 A * 5/1987 Moses ..... H01R 13/6395 174/67

8,011,977 B2 * 9/2011 Tsuruta ..... H01R 13/4365 439/752

OTHER PUBLICATIONS

Safety Plug, Nov. 1, 1976, IBM Technical Disclosure Bulletin, Nov. 1972, vol. 19, Issue 6, p. 1975.*

* cited by examiner

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

A device connector to be mounted and fixed to a case of a device includes a case-side connector to be fixed to the case by fitting a tool such as an impact wrench to a bolt head provided on a fixing bolt and tightening the fixing bolt into the case, a mating connector to be connected to the case-side connector and fixed to the case by tightening a connecting bolt into the case with the mating connector mounted on the case-side connector, and an access prohibiting portion provided on the mating connector and configured to prohibit the tool from being fitted to the bolt head by being arranged in proximity to the bolt head of the fixing bolt when the mating connector is mounted on the case-side connector.

5 Claims, 10 Drawing Sheets

DEVICE CONNECTOR

BACKGROUND

1. Field of the Invention

The invention relates to a device connector.

2. Description of the Related Art

U.S. Pat. No. 8,011,977 discloses a device connector to be fixed to a case of a device. This device connector has a case-side housing to be fixed to the case of the device while being covered by a case-side shell made of metal, and a mating housing to be connected to the case-side housing while being covered by a mating shell made of metal. A bolt is used to fix the case-side shell and the case-side housing to the case. The mating housing then is fit lightly to the case-side housing. A connecting bolt on the mating shell then is tightened into the case-side shell to connect the mating housing and the case-side housing and also to fix the mating shell and the case-side shell in an electrically connected state.

The fixing bolt and the connecting bolt of the above described connector may be identical or similar. Thus, an operator may break the fixing bolt by erroneously further tightening the fixing bolt during the connecting operation or may cause rattling of the case-side housing by erroneously loosening the fixing bolt during a connector separating operation.

The invention was completed based on the above situation and an object thereof is to prevent an operator from erroneously accessing a fixing bolt.

SUMMARY OF THE INVENTION

The invention is directed to a device connector to be mounted and fixed to a case of a device. The device connector includes a case-side connector to be fixed to the case by fitting a tool to a bolt head on a fixing bolt and tightening the fixing bolt into the case. A mating connector is to be connected to the case-side connector and fixed to the case by tightening a connecting bolt into the case with the mating connector mounted on the case-side connector. An access prohibiting portion is provided on the mating connector and is configured to prohibit the tool from being fit to the bolt head by being arranged near the bolt head when the mating connector is mounted on the case-side connector. Thus, the tool cannot be fit to the fixing bolt and an operator cannot erroneously access the fixing bolt. Accordingly, the fixing bolt will not be broken by tightening when connecting the mating connector and rattling of the device connector will not be caused by erroneously loosening the fixing bolt when separating the connectors.

The access prohibiting portion may be arranged behind the fixing bolt in a tightening direction of the fixing bolt when the mating connector is mounted on the case-side connector. Accordingly, the tool, such as an impact wrench, cannot be fit to the bolt head from behind.

The mating connector may have a metal shield shell that is fixed and electrically connected to the case. The access prohibiting portion may be integral to the shield shell and can be formed while forming the metal shield shell, for example, by die cast molding. The metal access prohibiting portion is stronger than one formed from resin and will be difficult to break even if contacted by the tool or another member.

The access prohibiting portion may include a plate-like projection projecting from an outer wall of the shield shell and a reinforcing rib may be connected integrally to the shield shell and the projection.

Enhanced strength could be achieved by thickening the projecting piece when forming the access prohibiting portion together with the shield shell by die cast molding. However, air bubbles may be produced in the thick projection and cracks may be formed in the projection. However, the reinforcing rib enhances the strength of the access prohibiting portion without increasing the thickness of the projection.

The access prohibiting portion may have a size as to conceal the rear surface of the bolt head from behind in a tightening direction. Accordingly, the bolt head can be made invisible from behind in the tightening direction in a state where the mating connector is mounted on the case-side connector, thereby further preventing the operator from accessing the fixing bolt.

The access prohibiting portion may be a box for covering the entire bolt head from behind in a tightening direction. Thus, the bolt head of the fixing bolt is invisible to the operator from behind and from a lateral side when the mating connector is mounted on the case-side connector. Accordingly, the operator cannot access the fixing bolt.

DETAILED DESCRIPTION OF THE PREFERRED EMBODIMENTS

Figure 1:
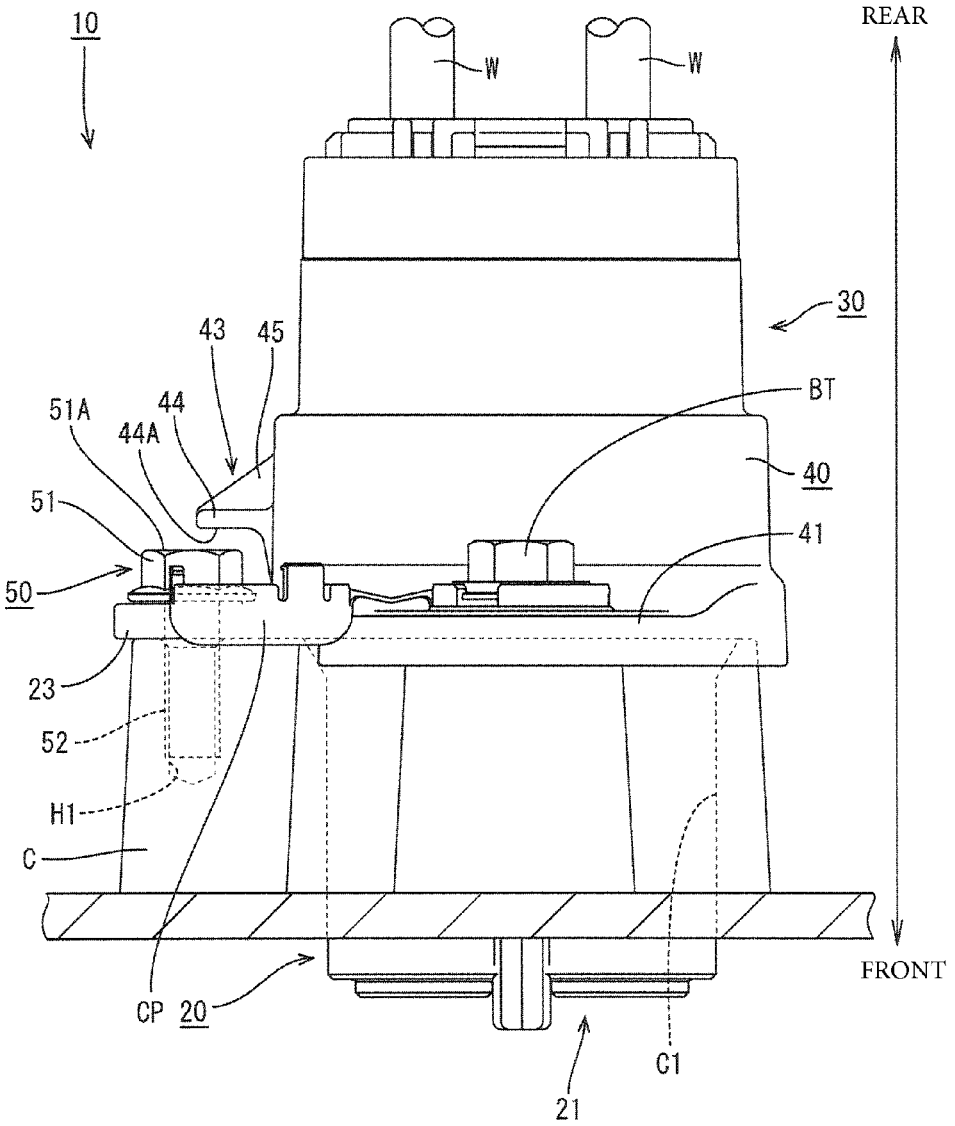
FIG. 1 is a front view of a device connector in a first embodiment.
Figure 2:
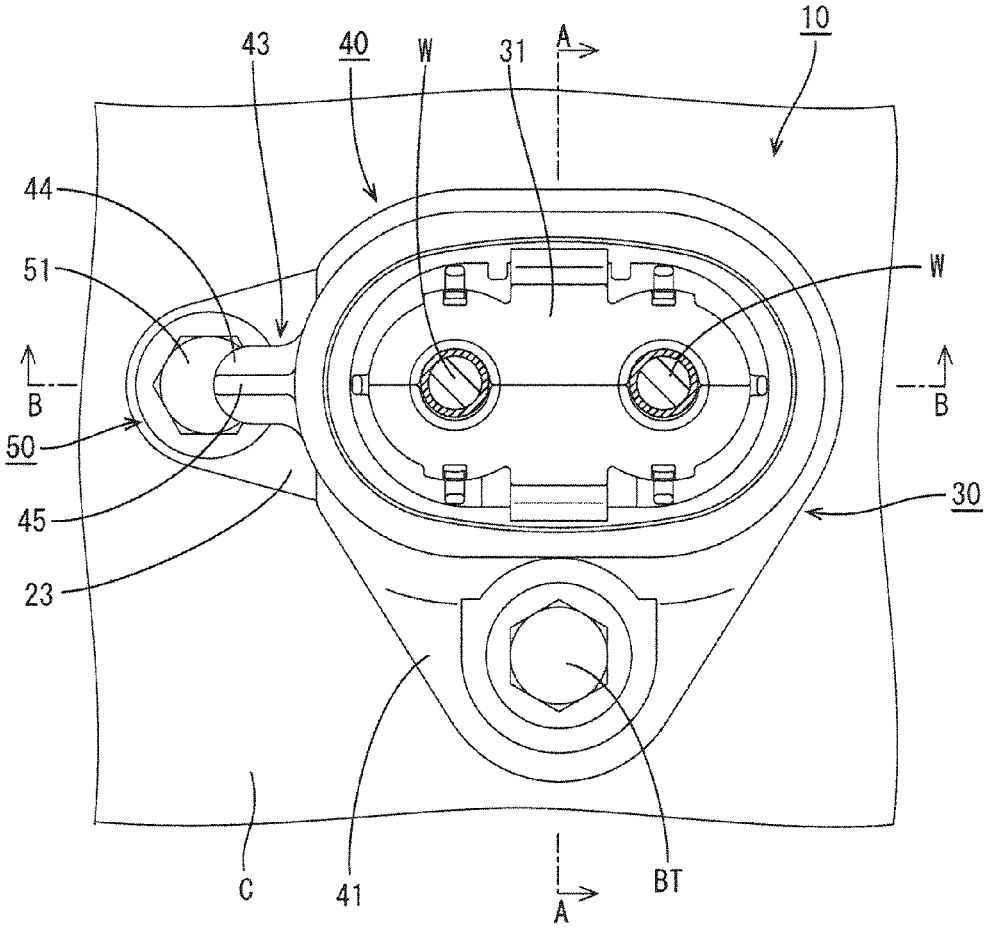
FIG. 2 is a plan view of the device connector.
Figure 3:
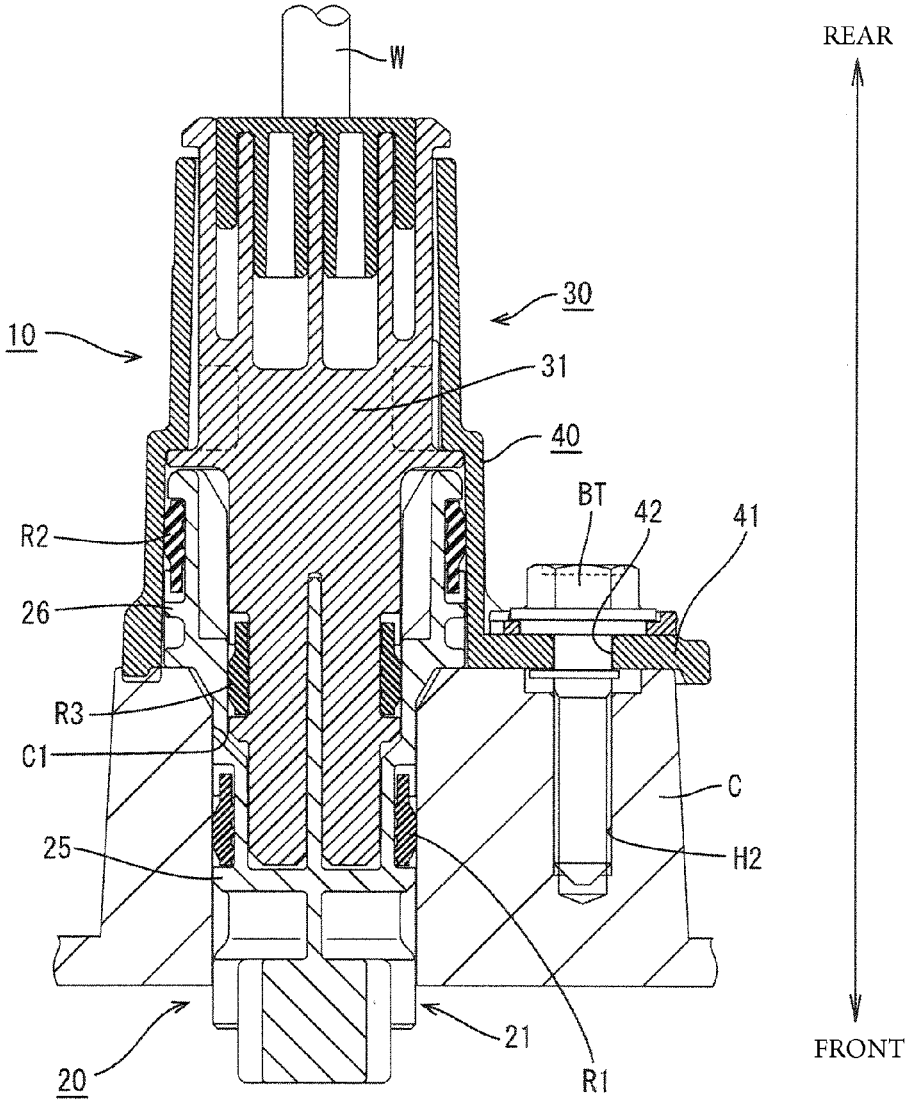
FIG. 3 is a section along A-A of FIG. 2.
Figure 4:
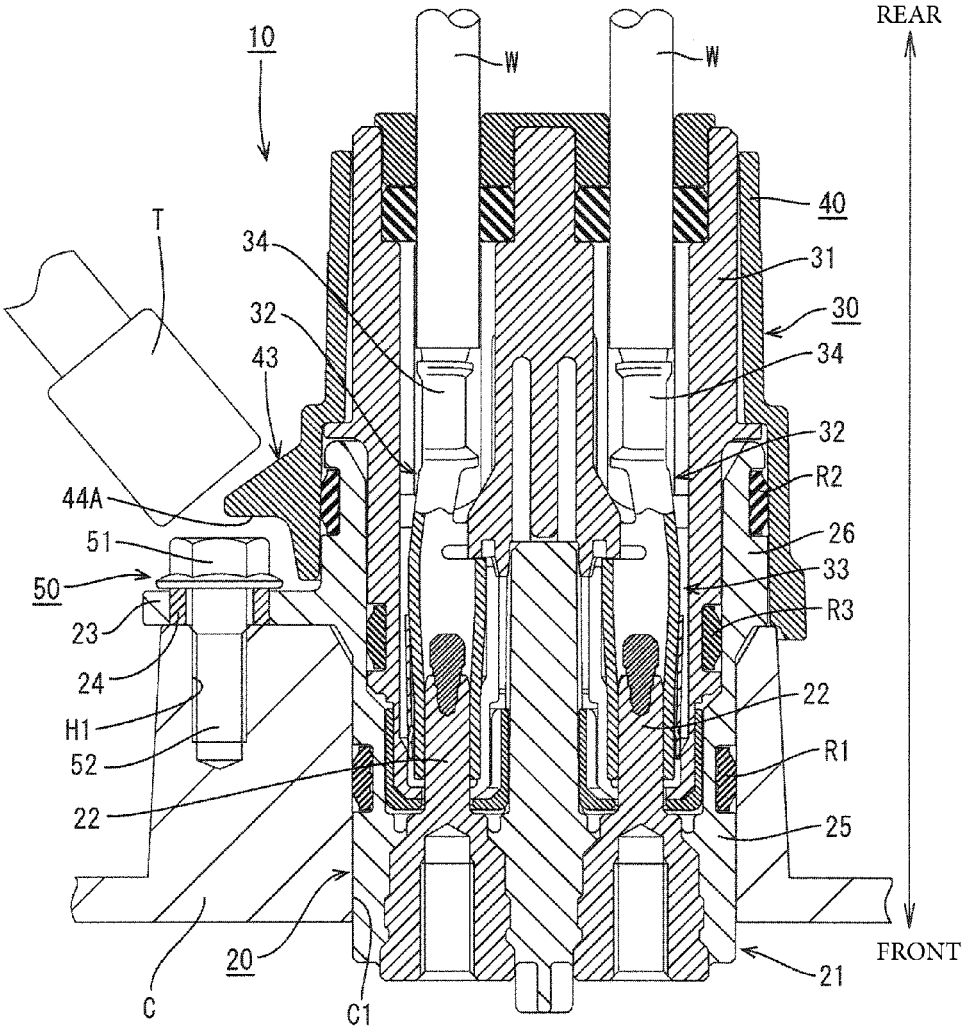
FIG. 4 is a section along B-B of FIG. 2.

A device connector in accordance with a first embodiment of the invention is identified by the numeral 10 in FIGS. 1 to 6. As shown in FIGS. 1 and 4, the device connector 10 includes a case-side connector 20 and a wire-side connector 30. The case-side connector 20 is to be fixed and fit into a mounting hole C1 in a case C. The wire-side connector 30 is provided on ends of wires W and is connected to the case-side connector 20. In the following description, forward and backward directions are based on a mounting direction of the device connector 10 onto the case C in FIG. 4, and a side to be mounted on the case C is referred to as a front side.

The case C of the device is made of electrical conductive metal and the mounting hole C1 enables the inside and outside of the case C to communicate. A fixing bolt hole H1 and a connecting bolt hole H2 are formed on the case C near the mounting hole C1. A fixing bolt 50 can be tightened into the fixing bolt hole H1 for fixing the case-side connector 20 to the case C, as shown in FIG. 4. The fixing bolt 50 has a bolt head 51 on one end and a shaft 52 extends in an axial direction from an axial central part of the bolt head 51. A screw thread is formed on the outer periphery of the shaft 52 and the shaft 52 is tightened into the fixing bolt hole H1 by rotating the bolt head 51 by a tool T. A connecting bolt BT can be tightened into the connecting bolt hole H2 for connecting the wire-side connector 30 and the case-side connector 20, as shown in FIG. 3. The connecting bolt BT has the same shape as the fixing bolt 50 and is tightened into the connecting bolt hole H2 by the tool T similarly to the fixing bolt 50.

The case-side connector 20 includes a case-side housing 21 made of synthetic resin and two male terminals 22 are accommodated in this case-side housing 21, as shown in FIG. 4. The male terminals 22 are connected to an unillustrated internal wiring of the device.

The case-side housing 21 is long in forward and backward directions and a laterally projecting fixing piece 23 is provided on the outer surface of the case-side housing 21. A metal collar 24 is formed integrally to the fixing piece 23. The metal collar 24 and the case C are bolted firmly in a state where the fixing bolt 50, the metal collar 24 and the case C are held directly in contact by inserting the fixing bolt 50 into the metal collar 24 and rotating the bolt head 51 of the fixing bolt 50 by the tool T to tighten the shaft 52 of the fixing bolt 50 into the fixing bolt hole H1 of the case C. In this way, the case-side connector 20 is mounted and fixed to the case without rattling.

A case-side fitting 25 is formed in the case-side housing 21 before the fixing piece 23 and can be fit into the mounting hole C1 of the case C. A connector fitting 26 is behind the fixing piece 23 and can be fit to the wire-side connector 30.

A case-side seal ring R1 is mounted on the outer peripheral surface of the case-side fitting 25. The case-side seal ring R1 seals between the outer peripheral surface of the case-side fitting 25 and the inner peripheral surface of the mounting hole C1 to prevent water from entering the case C when the case-side fitting 25 is fit into the mounting hole C1 of the case C. Further, a connector-side seal ring R2 is mounted on the outer peripheral surface of the connector fitting 26.

The wire-side connector 30 has a wire-side housing 31 and a shield shell 40 for covering the wire-side housing 31, as shown in FIGS. 3 and 4. The wire-side housing 31 is long in forward and backward directions and is made of synthetic resin.

A front part of the wire-side housing 31 can fit into the connector fitting 26 of the case-side housing 21. Two female terminals 32 are held in the wire-side housing 31. Each female terminal 32 includes a connecting tube 33 that is connectable to the male terminal 22 of the case-side connector 20 and a barrel 34 behind the connecting tube 33 for connection to the end of the wire W. The connectors 20, 30 are connected when the wire-side housing 31 is fit into the connector fitting 26 so that the male terminals 22 and the connecting tubes 33 of the female terminals 32 are connected electrically.

A seal ring R3 is mounted on the outer peripheral surface of the wire-side housing 31 and seals between the inner peripheral surface of the connector fitting 26 and the outer peripheral surface of the wire-side housing 31 to prevent water from entering into the housings 21, 31 when the wire-side housing 31 is fitted into the connector fitting 26.

The shield shell 40 is made of electrically conductive metal and formed to have a substantially uniform thickness, for example, by aluminum die casting. The shield shell 40 is substantially tubular and is held on the wire-side housing 31 by being locked by a locking portion (not shown) on the wire-side housing 31. The case-side seal ring R2 of the case-side housing 21 closely contacts the inner peripheral surface of the shield shell 40 over the entire circumference to prevent water from entering into the shield shell 40 through a clearance between the two connectors 20, 30 when the connectors 20, 30 are connected. A front end part of the shield shell 40 contacts a peripheral part of the mounting hole C1 of the case C from behind to be electrically connected as the two connectors 20, 30 are connected. In this way, the two housings 21, 31 are shielded entirely.

A pedestal 41 projects laterally on the front part of the shield shell 40, as shown in FIGS. 2 and 3. A bolt insertion hole 42 is formed in the pedestal 41 and can receive the connecting bolt BT. An unillustrated E-ring is mounted after the connecting bolt BT is inserted into the bolt insertion hole 42 to hold the connecting bolt BT on the pedestal 41. In connecting the two connectors 20, 30, the wire-side housing 31 is fit lightly fitted into the connector fitting 26 and the connecting bolt BT is tightened into the connecting bolt hole H2 to bring the pedestal 41 closer to the case C and to bring the two connectors 20, 30 to a properly connected state.

A hinged bolt cap CP is mounted between the pedestal portion 41 and the connecting bolt BT and is mountable on the connecting bolt BT from behind after the two connectors 20, 30 are connected. Although the bolt cap CP is mounted on the connecting bolt BT in this embodiment, it is not always necessary to mount a bolt cap on the connecting bolt BT and no bolt cap is shown in FIG. 2.

As shown in FIGS. 1, 2 and 4, an access prohibiting portion 43 is provided on the outer surface of the shield shell 40. The access prohibiting portion 43 is in proximity to the fixing bolt 50 when the wire-side connector 30 is mounted on the case-side connector 20 and is behind fixing bolt 50 in a tightening direction thereof. The access prohibiting portion 43 is more proximate to the fixing bolt 50 when the two connectors 20, 30 are connected properly.

The access prohibiting portion 43 is formed integrally to the shield shell 40 when forming the shield shell 40 by aluminum die casting. Further, the access prohibiting portion 43 includes a projection 44 in the form of a flat plate projecting laterally from the outer surface of the shield shell 40. A front surface 44A of the projection 44 faces a rear surface 51A of the bolt head 51 of the fixing bolt 50 in forward and backward directions, and the thickness of the projection 44 is substantially equal to that of the shield shell 40. A clearance capable of taking up tolerances is provided between the front surface 44A of the projection 44 and the rear surface 51A of the bolt head 51, considering manufacturing tolerances and assembling tolerances of the shield shell 40, the fixing bolt 40 and the like, in this embodiment, the front surface 44A of the projection 44 and the rear surface 51A of the bolt head 51 may be held in contact without being limited to this. A reinforcing rib 45 is provided unitarily on the rear surface of the projecting piece 44 to enhance the strength of the projection 44.

A projection could be thickened to increase the strength of an access prohibiting portion. However, a thick projection on an access prohibiting portion formed by die cast molding could have air bubbles that may cause cracks and the like in the projecting piece in. The reinforcing rib 45 increases the strength of the access prohibiting portion 43 without thickening the projection 44 and hence avoids the formation of cracks.

The projecting end of the projection 44 is rounded and projects up to substantially the same position as the axial center of the fixing bolt 50. Thus, while the wire-side connector 30 is mounted on the case-side connector 20 to connect the two connectors 20, 30, the projecting piece 44 and a part of the bolt head 51 of the fixing bolt 50 are proximate to each other and overlap in forward and backward directions when the device connector 10 is viewed from behind (see FIG. 2). This prevents the tool T, such as an impact wrench, from being fit to the bolt head 51 of the fixing bolt 50 from behind.

Figure 5:
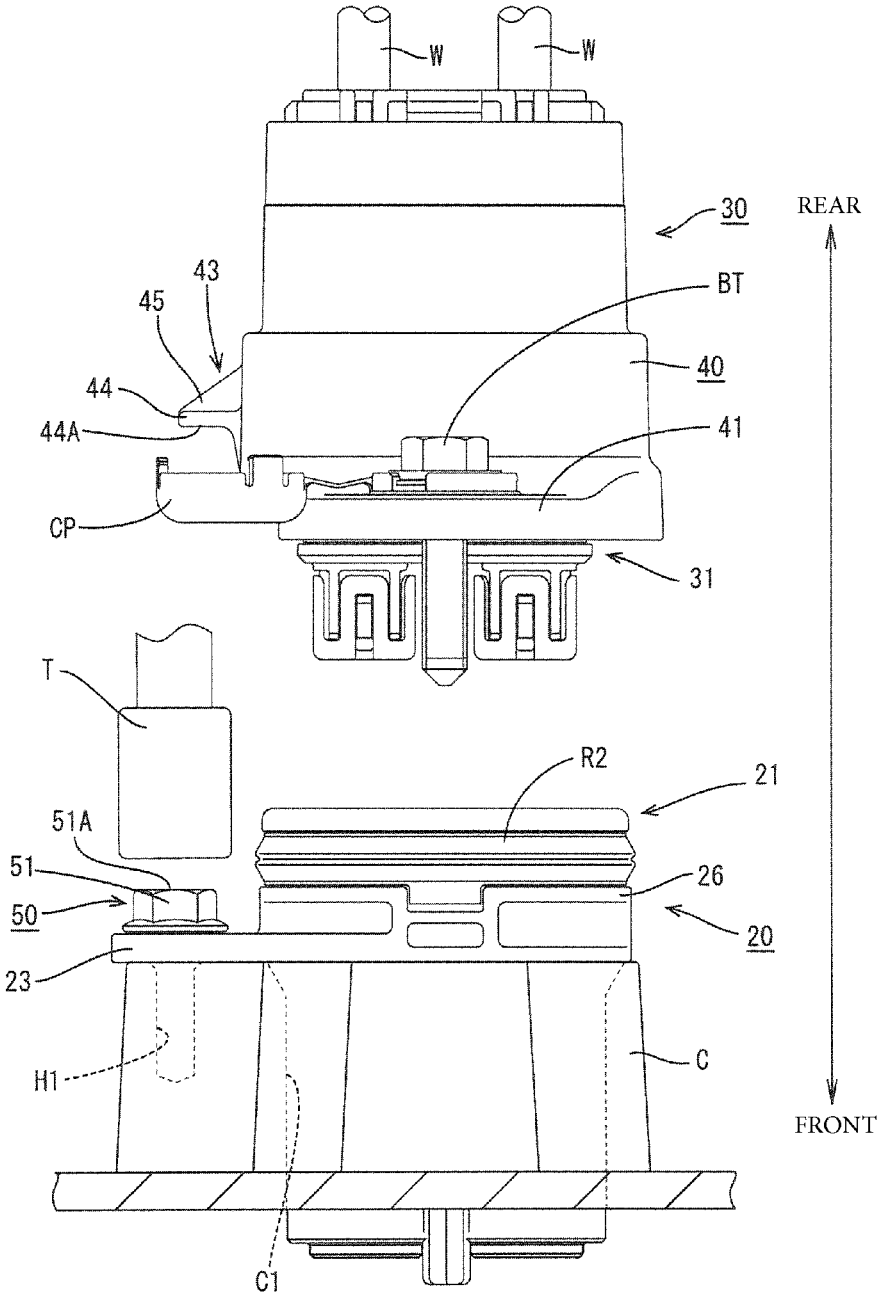
FIG. 5 is a front view showing a state before a wire-side connector and a case-side connector are connected.
Figure 6:
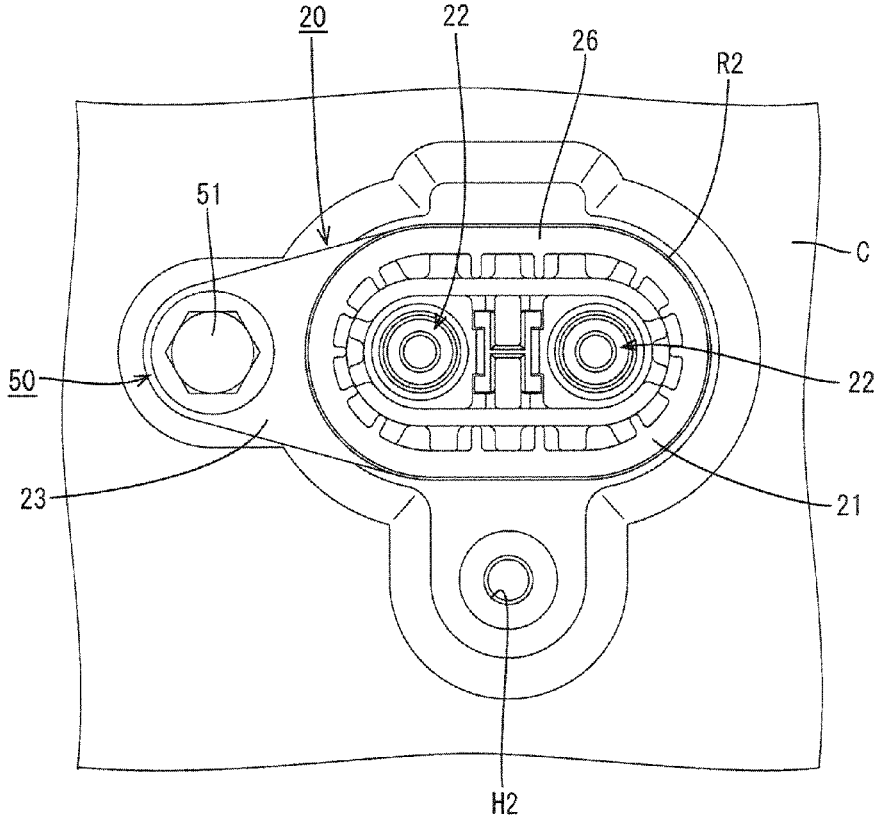
FIG. 6 is a plan view showing a state where the case-side connector is fixed to a case.

The device connector 10 of this embodiment is assembled by initially inserting the case-side connector 20 into the mounting hole C1 of the case C to a proper position. The fixing bolt 50 then is inserted into the metal collar 24 of the fixing piece 23 of the case-side connector 20 and the bolt head 51 of the fixing bolt 50 is rotated by the tool T from behind. Accordingly, the shaft 52 of the fixing bolt 50 is tightened into the fixing bolt hole H1 of the case C and the case-side connector 20 is mounted and fixed to the case without rattling, as shown in FIG. 5. Nothing is arranged behind the fixing bolt 50 when fixing the case-side connector 20 to the case C, as shown in FIGS. 5 and 6. As a result, the tool T such as an impact wrench easily can be fit to the bolt head 51 of the fixing bolt 50.

The wire-side housing 31 then is fit lightly to the case-side housing 21 by hand and the connecting bolt BT is tightened into the connecting bolt hole H2 using the tool T so that the two connectors 20, 30 are connected, as shown in FIGS. 1 and 4. The connecting bolt BT and the fixing bolt 50 are shaped identically. Thus, an operator attempting to fit the tool T to the connecting bolt BT may erroneously fit the tool T to the fixing bolt 50 and further tighten the fixing bolt 50. However, the access prohibiting portion 43 of the shield shell 40 is near the fixing bolt 50 when the wire-side housing 31 is fit lightly to the case-side housing 21. Further, the access prohibiting portion 43 also is near the fixing bolt 50 when the two connectors 20, 30 are connected properly, as shown in FIGS. 1 and 4. Therefore, the tool T, such as an impact wrench, cannot be fit to the bolt head 51 of the fixing bolt 50 from behind and the fixing bolt 50 will not be broken by being erroneously further tightened by the operator during a connecting operation.

The wire-side connector 30 can be separated from the case-side connector 20 by fitting the tool T, such as an impact wrench, to the connecting bolt BT and loosening the connecting bolt BT so that the wire-side housing 31 gradually separates from the case-side housing 21. The tool T may be fittable to both the connecting bolt BT and the fixing bolt 50. Hence, there is a concern that the operator may erroneously loosen the fixing bolt 50 to cause rattling of the case-side connector 20. Thus, connection reliability between the male terminals 22 and the female terminals 32 might not be ensured when the two connectors 20, 30 are connected again.

However, according to this embodiment, the access prohibiting portion 43 of the shield shell 40 is behind and in proximity to the bolt head 51 of the fixing bolt 50 when the connectors 20, 30 are connected properly, as shown in FIGS. 1 and 4. Thus, the tool T such as an impact wrench cannot be fit to the bolt head 51 of the fixing bolt 50 from behind and the operator cannot erroneously loosen the fixing bolt 50 to cause rattling of the case-side connector 20.

As described above, according to this embodiment, the access prohibiting portion 43 can be arranged behind and in proximity to the bolt head 51 of the fixing bolt 50 when the wire-side connector 30 is mounted on the case-side connector 20. Thus, an operator cannot erroneously access the fixing bolt 50 when connecting or separating the wire-side connector 30. Accordingly, the fixing bolt 50 will not be broken during the connecting operation and the case-side connector 20 will not rattle due to loosening the fixing bolt 50 during the separating operation.

The access prohibiting portion 43 is formed unitarily with the metal shield shell 40 and therefore is stronger than an access prohibiting portion 43 made of resin or the like. Thus, the access prohibiting portion 43 is difficult to break even if contacted by a tool T, such as an impact wrench, or another member.

Figure 7:
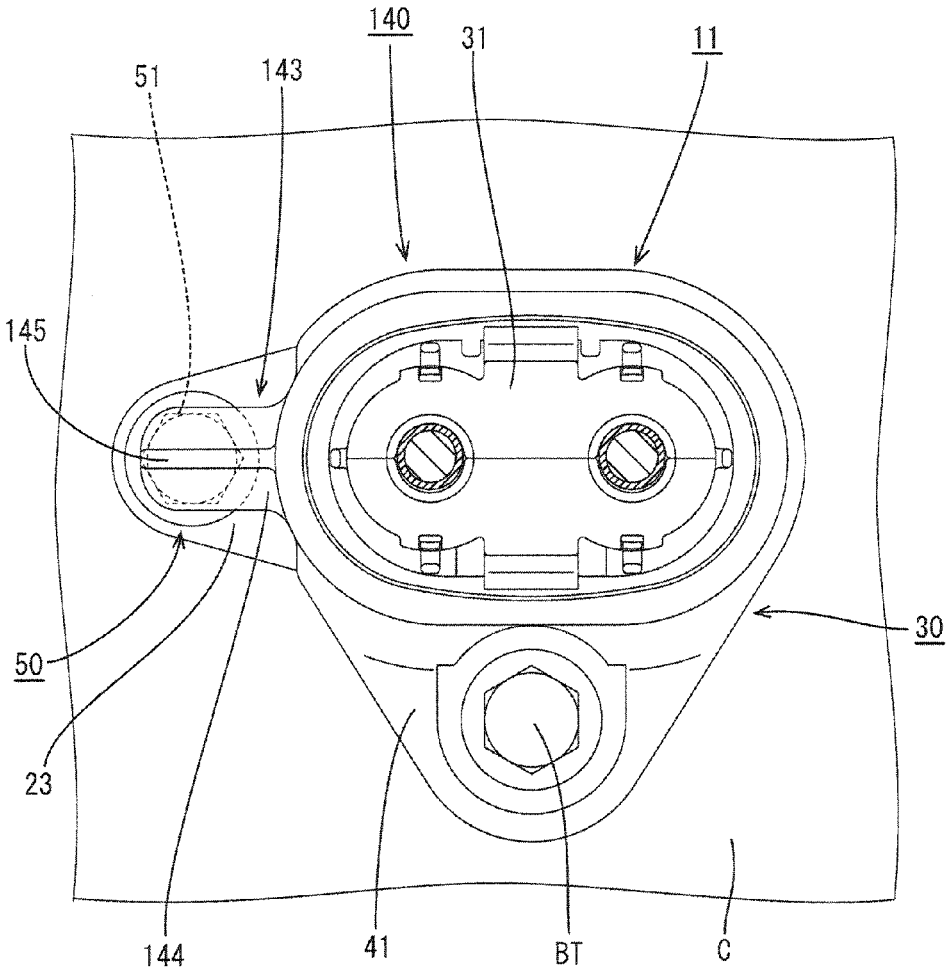
FIG. 7 is a plan view of a device connector in a second embodiment.
Figure 8:
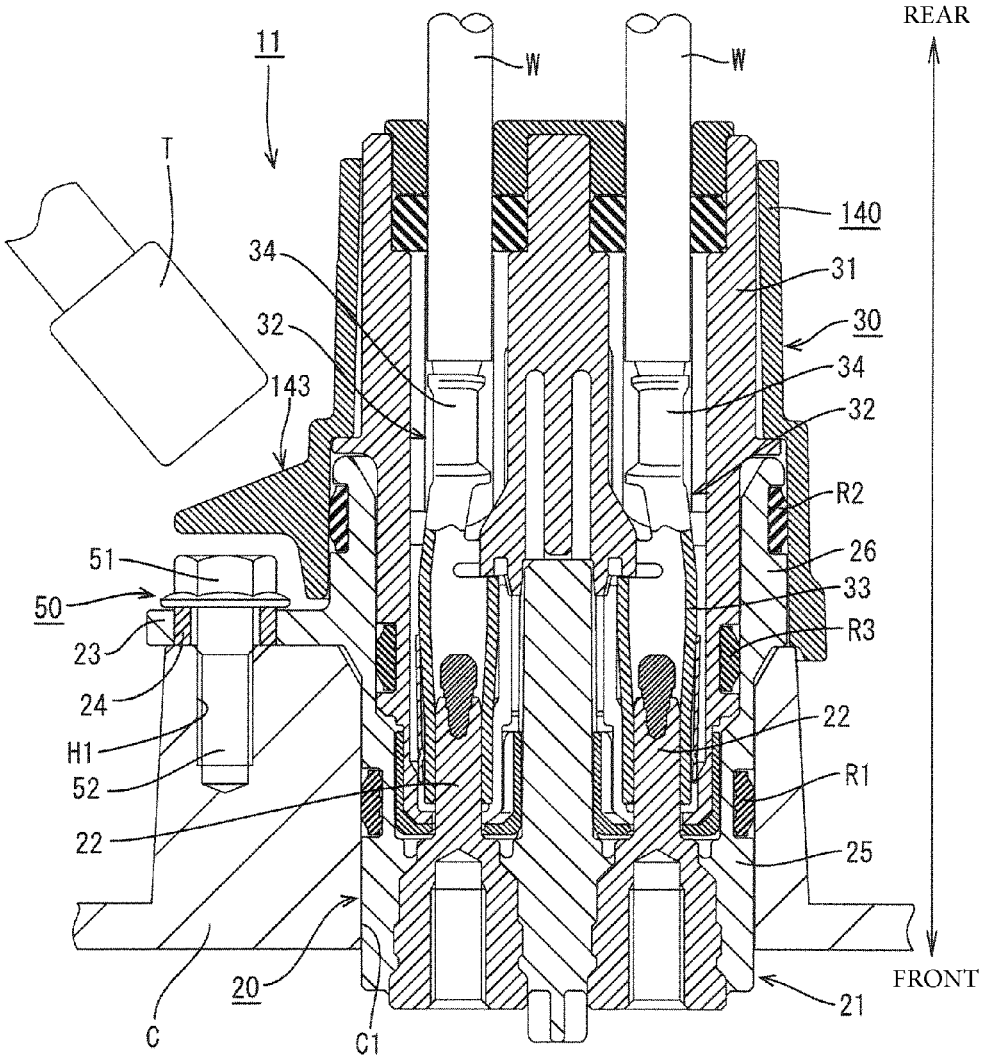
FIG. 8 is a section, equivalent to FIG. 4, in the second embodiment.

A device connector in accordance with a second embodiment of the invention is identified by the numeral 11 in FIGS. 7 and 8. The device connector 11 of the second embodiment differs from the first embodiment with respect to the shape of the access prohibiting portion. Parts of the second embodiment that are the same as the first embodiment are identified by the same reference numbers, but are not described again.

An of a shield shell 140 in the device connector 11 of the second embodiment has a shield shell 140 with an access prohibiting portion 143 that projects laterally a large amount, as shown in FIGS. 7 and 8, while having the same height as the access prohibiting portion 43 of the first embodiment. Specifically, a projecting piece 144 and a reinforcing rib 145 of the access prohibiting portion 143 project laterally from a lateral end part of a bolt head 51 of a fixing bolt 50, and a rear surface 51A of the bolt head 51 is completely concealed by the projecting piece 144 of the access prohibiting portion 143 when a wire-side connector 30 is mounted on a case-side connector 20 and the bolt head 51 of the fixing bolt 50 is viewed from behind. Specifically, the bolt head 51 of the fixing bolt 50 cannot be seen from behind when the wire-side connector 30 is mounted on the case-side connector 20, as shown in FIG. 7. This can further prevent erroneous access to the fixing bolt 50 by an operator.

Figure 9:
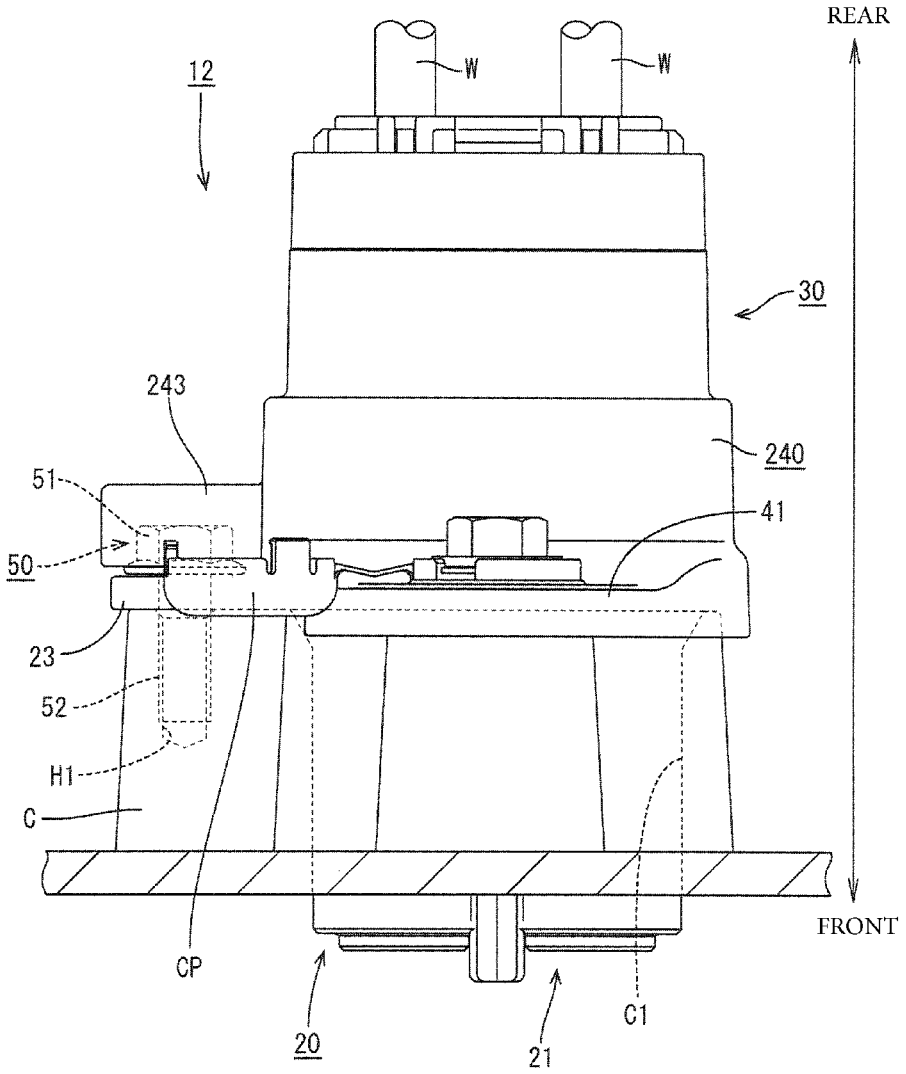
FIG. 9 is a front view of a device connector in a third embodiment.
Figure 10:
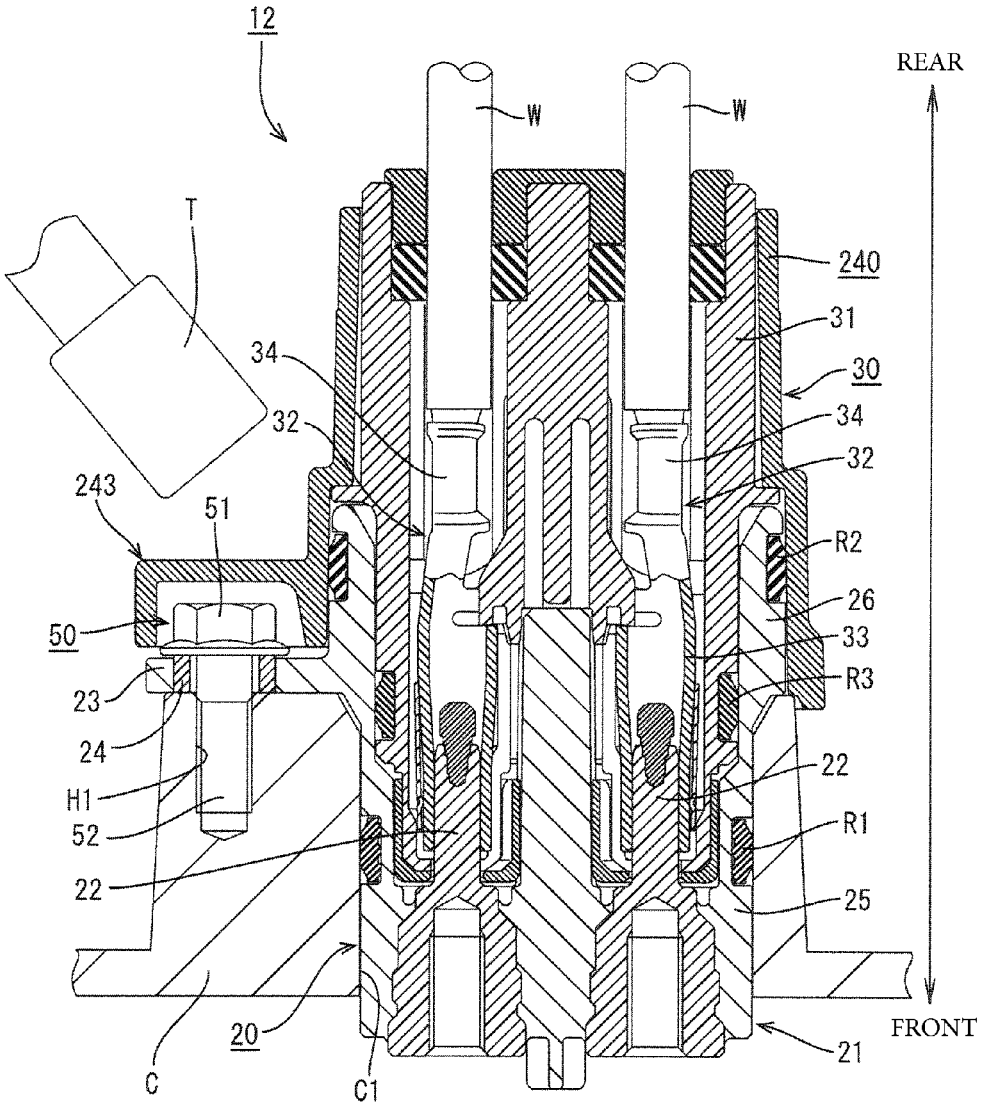
FIG. 10 is a section, equivalent to FIG. 4, in the third embodiment.

A device connector in accordance with a third embodiment of the invention is identified by the number 12 in FIGS. 9 and 10. The device connector 12 of the third embodiment differs from the first embodiment with respect to the shape of the access prohibiting portion. Parts of the third embodiment that are the same as the first embodiment are identified by the same reference numbers, but are not described again The device connector 12 of the third embodiment has a shield shell 240 with an access prohibiting portion 243 in the form of a box that is open forward, as shown in FIGS. 9 and 10. The access prohibiting portion 143 completely covers the entire bolt head 51 of the fixing bolt 50 when a wire-side connector 30 and a case-side connector 20 are connected properly. Specifically, the bolt head 51 of the fixing bolt 50 is invisible from behind and from a lateral side as shown in FIG. 9 when the wire-side connector 30 is mounted on the case-side connector 20, thereby further preventing erroneous access to the fixing bolt 50.

The invention is not limited to the above described embodiments. For example, the following embodiments also are included in the scope of the invention.

The access prohibiting portion 43, 143 is arranged behind and in proximity to the bolt head 51 of the fixing bolt 50 in the first and second embodiments and the bolt head 51 is covered completely in the third embodiment. However, an access prohibiting portion may be arranged lateral to and in proximity to the bolt head 51 of the fixing bolt 50 or the bolt head 51 of the fixing bolt 50 may be covered by the access prohibiting portion together with the fixing piece 23.

The shield shell 40, 140, 240 is provided with the access prohibiting portion 43, 143, 243 in the above embodiments. However, the wire-side housing may be provided with an access prohibiting portion.

Although the case-side connector 20 is fixed to the case C by fixing the case-side housing 21 to the case C in the above embodiments, the present invention is not limited to such a mode. For example, the case-side connector may be provided with a case-side shield shell and fixed to the case by fixing the case-side shield shell to the case.

Although the projecting piece 44, 144 projects from the outer surface of the shield shell 40 up to the axial center of the bolt head 51 or the vicinity of the lateral end part of the bolt head 51 in the first and second embodiments. However, a projecting amount of the projecting piece from the shield shell may be appropriately determined in consideration of the size, the insertion angle and the like of the tool to be fitted to the bolt head.

What is claimed is:

1. A device connector to be mounted and fixed in a mounting hole of a case of a device, the case having a fixing bolt hole and a connecting bolt hole spaced from one another and spaced from the mounting hole, comprising:

a case-side connector having a resin housing mounted in the mounting hole of the case and a fixing piece projecting unitarily from the housing and surrounding the fixing bolt hole, the case-side connector being fixed to the case by passing a shaft of a fixing bolt through the fixing piece and into the fixing bolt hole and by fitting a tool to a bolt head provided on the fixing bolt and tightening the fixing bolt into the case;

a mating connector to be connected to the case-side connector and including a shield shell made of metal and telescoped onto the resin housing of the case-side connector, the shield shell including a pedestal projecting laterally from the mating connector and supported directly on the case at a position surrounding the connecting bolt hole of the case, the mating connector being fixed to the case by passing a connecting bolt through the pedestal and tightening the connecting bolt into the connecting bolt hole of the case with the mating connector mounted on the case-side connector; and an access prohibiting portion projecting unitarily out on the shield shell to a position opposed to the bolt head of the fixing bolt when the mating connector is mounted on the case-side connector to prohibit the tool from being fit to the bolt head, the access prohibiting portion having an outer periphery inward of an outer periphery of the fixing piece of the case-side connector.

2. The device connector of claim 1, wherein:

the access prohibiting portion includes a plate-like projection projecting from an outer wall of the shield shell; and the projection having a reinforcing rib unitary with the shield shell and the projection.

3. The device connector of claim 1, wherein the access prohibiting portion is arranged behind the fixing bolt in a tightening direction of the fixing bolt when the mating connector is mounted on the case-side connector.

4. The device connector of claim 3, wherein the access prohibiting portion is configured to conceal a rear surface of the bolt head from behind in a tightening direction.

5. A device connector to be mounted and fixed in a mounting hole of a case of a device, the case having a fixing bolt hole and a mounting bolt hole spaced from one another and spaced from the mounting hole, comprising:

a case-side connector having a resin housing mounted in the mounting hole of the case and a fixing piece projecting unitarily from the housing and surrounding the fixing bolt hole, the case-side connector being fixed to the case by passing a shaft of a fixing bolt through the fixing piece and into the fixing bolt hole and fitting a tool to a bolt head provided on the fixing bolt and tightening the fixing bolt into the case;

a mating connector to be connected to the case-side connector and including a shield shell made of metal and telescoped onto the resin housing of the case-side connector, the shield shell including a pedestal projecting laterally from the mating connector and supported directly on the case at a position surrounding the mounting bolt hole of the case, the mating connector being fixed to the case by passing a connecting bolt through the pedestal tightening the connecting bolt into the mounting bolt hole of the case with the mating connector mounted on the case-side connector; and an access prohibiting portion provided unitarily on the shield shell, the access prohibiting portion being in the form of a box covering the entire bolt head circumferentially and from behind in a tightening direction to prohibit the tool from being fit to the bolt head.

* * * * *